United States Patent [19]

Petraud

[11] Patent Number: 4,535,555

[45] Date of Patent: Aug. 20, 1985

[54] TRENCHER WITH PLURAL DIGGING WHEELS HAVING ADJUSTABLE INCLINATION

[75] Inventor: Gilles Petraud, Moncoutant, France

[73] Assignee: Cerimon, Moncoutant, France

[21] Appl. No.: 585,215

[22] Filed: Feb. 28, 1984

[30] Foreign Application Priority Data

Mar. 4, 1983 [FR] France ..... 83 03602

[51] Int. Cl.[3] ..... E02F 5/08

[52] U.S. Cl. ..... 37/94; 37/DIG. 16

[58] Field of Search ..... 37/DIG. 16, 80 A, 87, 37/91, 94, 97, 189

[56] References Cited

U.S. PATENT DOCUMENTS

| | | | |
|---|---|---|---|
| 929,732 | 8/1909 | Van Buren et al. | 37/97 |
| 3,126,653 | 3/1964 | Bourgeous | 172/4.5 |
| 3,208,168 | 9/1965 | Henschen | 37/97 |
| 3,548,570 | 12/1970 | Knott et al. | 37/189 X |
| 3,681,863 | 8/1972 | Soltnser et al. | 37/DIG. 16 |
| 4,161,072 | 7/1979 | Pronorost | 37/DIG. 16 |

FOREIGN PATENT DOCUMENTS

| | | | |
|---|---|---|---|
| 960392 | 3/1957 | Fed. Rep. of Germany . | |
| 1658017 | 11/1971 | Fed. Rep. of Germany . | |
| 2123934 | 11/1972 | Fed. Rep. of Germany | 37/DIG. 16 |
| 1429215 | 5/1966 | France . | |
| 2137846 | 12/1972 | France . | |
| 2234429 | 1/1975 | France | 37/91 |
| 2378139 | 8/1978 | France . | |
| 156489 | 4/1962 | U.S.S.R. | 37/91 |
| 183675 | 8/1966 | U.S.S.R. | 37/91 |
| 256651 | 3/1971 | U.S.S.R. | 37/91 |
| 646012 | 2/1979 | U.S.S.R. | 37/94 |

*Primary Examiner*—Clifford D. Crowder

*Attorney, Agent, or Firm*—Wenderoth, Lind & Ponack

[57] ABSTRACT

The machine includes a frame on which is suspended on a shaft a support for two inclined cutters. The support includes slots of different inclination in which are mounted guide rollers connected to housings in which inclined cutters are rotatively mounted. A jack shifts the housings and consequently adjusts the inclination of the cutters. An additional cutter is located in front of the inclined cutters and is adapted to effect a rough cutting of the trench. A smoothing shoe is openable to a variable extent with the inclination of the cutters.

9 Claims, 6 Drawing Figures

TRENCHER WITH PLURAL DIGGING WHEELS HAVING ADJUSTABLE INCLINATION

BACKGROUND OF THE INVENTION

Machines are known which comprise two cutters which have a trapezoidal section and are inclined to the vertical and rotatively mounted on a frame adapted to be coupled to a platform, these cutters effecting digging of ditches having a trapezoidal cross-sectional shape.

Machines are also known for digging which have a single wheel or cutter in the shape of a double truncated cone which also produce ditches having inclined walls. These machines, whose cutters are driven by the power take-off of the tractor or by hydraulic motors, only permit the production of relatively shallow ditches or the cutting of the ditch in a plurality of successive passes, which constitutes a considerable loss of time and energy.

Further, both in machines having two inclined cutters and those having a single cutter, the relative position and the shape of the tools determine the profile of the ditch produced without the possibility of modifying this profile.

SUMMARY OF THE INVENTION

An object of the invention is to overcome the aforementioned drawbacks by providing a machine for digging and cleaning out trenches which has an increased capacity relatively to the known machines and yet enables trenches having different profiles to be produced.

The invention therefore provides a machine for digging and cleaning out trenches comprising two cutters having a frustoconical section and axes inclined to the horizontal rotatively mounted on a frame, wherein there are also provided means for adjusting the inclination of the cutters so as to modify the inclination of the walls of the trench to be produced.

Another object of the invention is to provide a machine of the aforementioned type which further comprises an additional cutter, disposed in front of the two inclined cutters relative to the direction of travel of the machine, and adapted to effect a rough digging of the trench to be produced by the machine.

BRIEF DESCRIPTION OF THE DRAWINGS

Further features and advantages of the invention will be apparent from the following description which is given solely by way of example with reference to the accompanying drawings, in which.

DETAILED DESCRIPTION OF THE INVENTION

Figure 1:
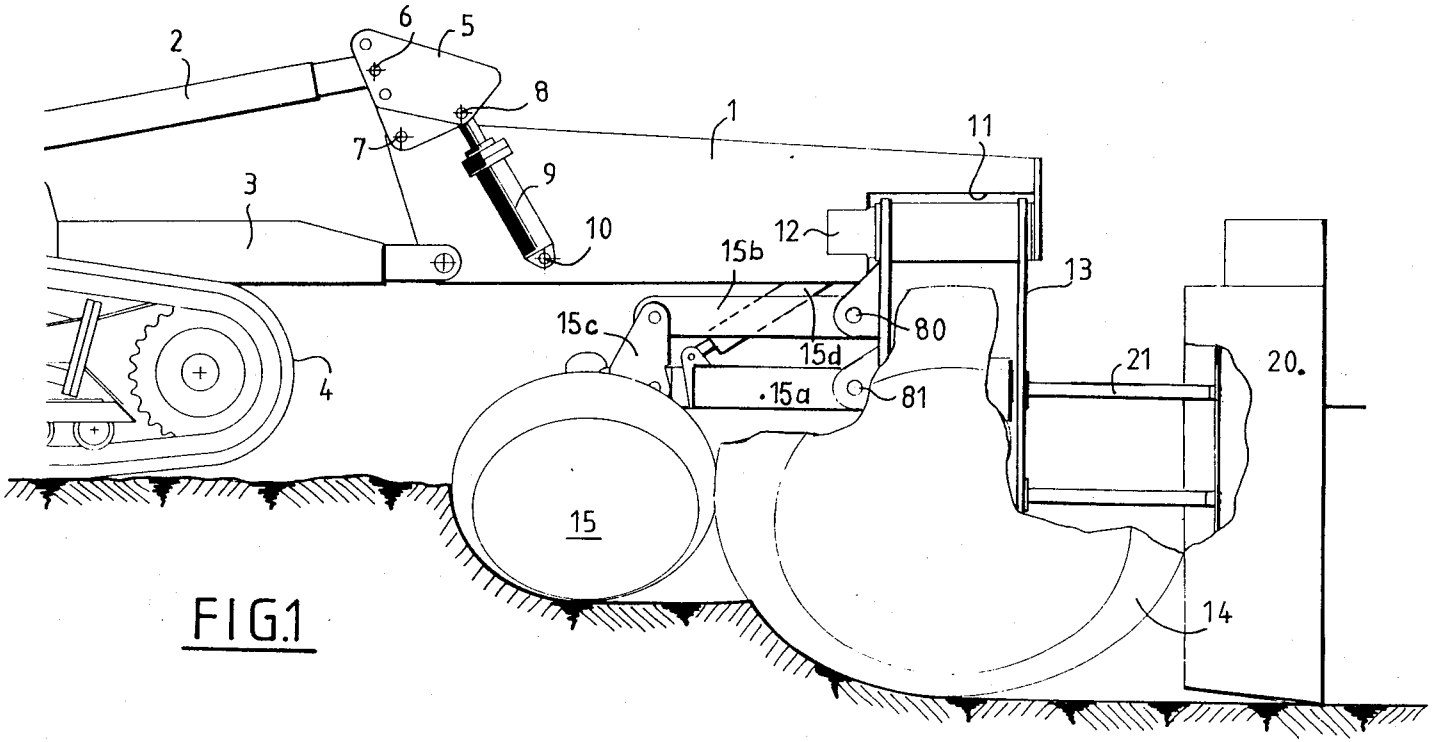
FIG. 1 is a general diagrammatic view of the machine for digging or cleaning out trenches according to the invention.

The machine for digging trenches according to the invention and shown in FIG. 1 comprises mainly a frame 1 in the shape of a beam pivotally mounted at the end of carrying arms 2 and 3 which are part of a tractor 4. The frame 1 is connected to the upper arm 2 by a generally triangular-shaped fork element 5. At a point of element 5, which is outside a line joining pivot axes 6 and 7 of the fork element on the arm 2 and on the frame 1 is pivotally mounted an end 8 of a jack 9 for adjusting the inclination of the frame 1 in depth, the other end of the jack 9 being pivotally connected to said frame at point 10.

At the end of the frame 1 opposed to its pivotal connection to the support arms 2 and 3 of the tractor, this frame has a recess 11 in which is mounted a suspension shaft 12 of a support 13 of two inclined cutters 14 of frustoconical shape. Mounted on this support 13 is also an additional cutter 15 in the shape of a double truncated cone adapted, when the machine is employed for digging a trench, to effect a rough cutting of the trench and disposed consequently in front of the two main cutters 14 relative to the direction of travel of the machine. The cutter 15 is mounted on the support 13 by a deformable parallelogram structure two of the branches of which are formed by links 15*a*, 15*b* which are pivotally mounted, on one hand, on the support 13 and, on the other hand, on a head 15*c* carrying the shaft of rotation of the cutter 15. A jack 15*d* for adjusting the depth of the additional cutter 15 is pivotally mounted between the support 13 and one of the links 15*a* of the deformable parallelogram articulation structure.

Disposed at the rear of the machine constructed in this way is a smoothing shoe 20 fixed to the support 13 of the inclined cutters by means of bars 21.

Figure 2:
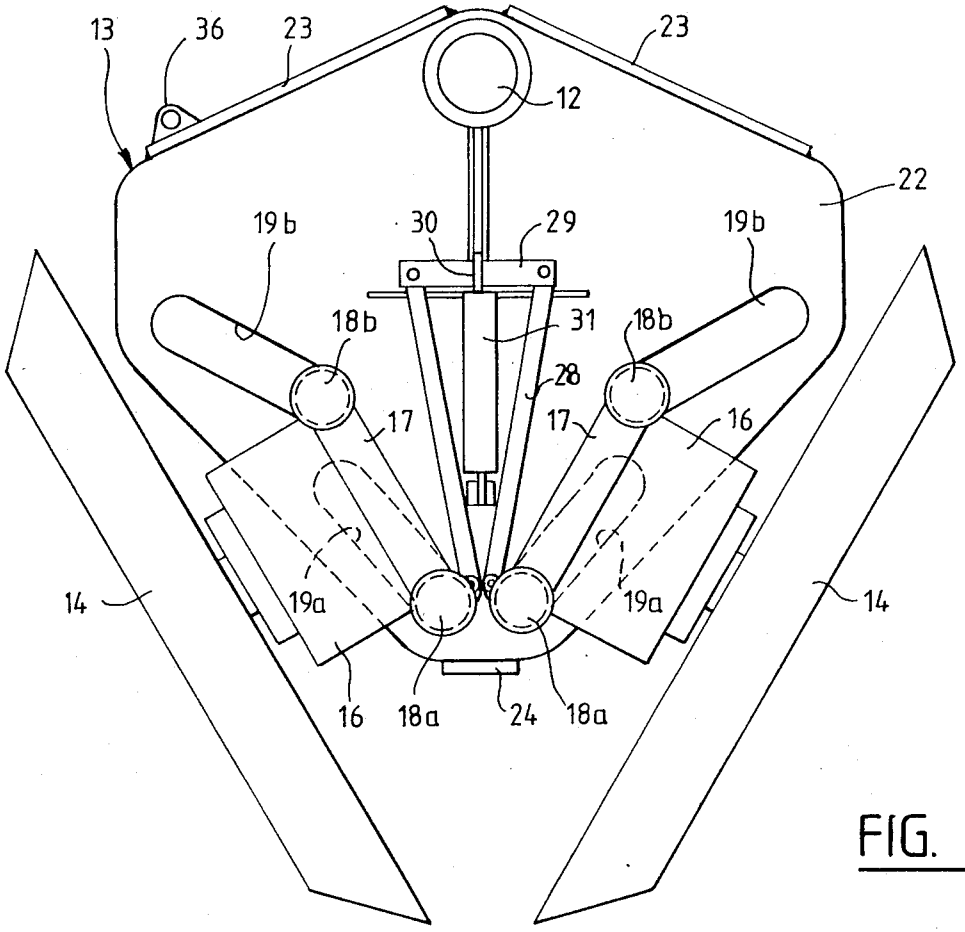
FIG. 2 is an end elevational view of the machine from which the smoothing shoe and rear side wall have been removed, there being shown the means for fixing and supporting the adjustably inclined cutters.

FIG. 2 shows the means for mounting and adjusting the inclination of the frustoconical cutters 14 relative to the cutter support 13. It can be seen in this Figure that each of the cutters 14 is rotatively mounted in a cylindrical housing 16 in a manner which will be described with reference to FIG. 3. Each cylindrical housing 16 has, at the end thereof opposed to the corresponding cutter 14, two rectilinear bars 17 which are welded to the outer surface of the housing and adapted to support shouldered guide rollers 18*a*, 18*b* respectively engaged in slots 19*a*, 19*b* having different inclinations and formed in two side walls 22 of the support 13. The slots 19*a* and 19*b* for guiding the corresponding rollers associated with each housing 16 are symmetrical in pairs relative to the axis of symmetry of the support 13. The side walls 22 are interconnected by upper metal plates 23 and a sheet metal bottom wall 24 welded to the edges of the side walls 22.

Figure 4:
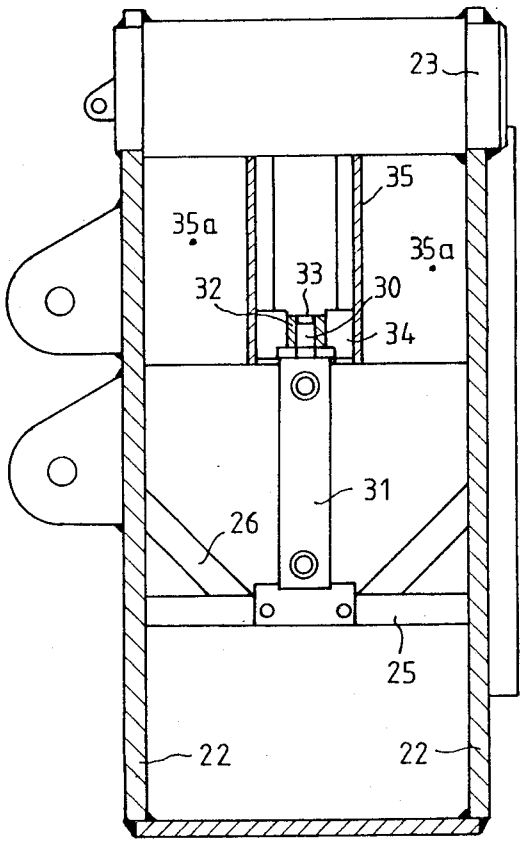
FIG. 4 is a sectional view of the support of the cutters having an adjustable inclination.

As moreover shown in FIG. 4, the support 13 includes interior reinforcing elements formed by flat strips 25, 26 and other reinforcing elements adapted to stiffen the structure. Each housing 16 has at the lower end of one of the bars 17 supporting the rollers 18*a*, 18*b* a lug 27 on which is pivotally mounted a link 28 shifted by inclination of the housing 16, this link being pivotally mounted on a cross-member 29 fixed to the upper end of the rod 30 of a hydraulic jack 31 whose cylinder is secured to the cross-member 25 of the support 13.

Means for guiding the rod 30 of the jack are provided so that the cross-member 29 always remains perpendicular to the axis of symmetry of the support 13 and thus always permits the obtainment of the same inclination of the two cutters 14 relative to this axis of symmetry. These guide means are described in detail with reference to FIG. 4.

The cross-member 29 is in fact formed by two parallel flat strips 32 which are welded to blocks 34 forming slides which are slidably mounted in vertical guides 35 welded to the upper plates 23 and to vertical plates 35*a*. FIG. 2 shows that the support 13 has in its upper part a fork 36 for the pivotal connection of the end of a jack for adjusting the inclination of the support 13 by rotation of the latter about the shaft 12.

Figure 3:
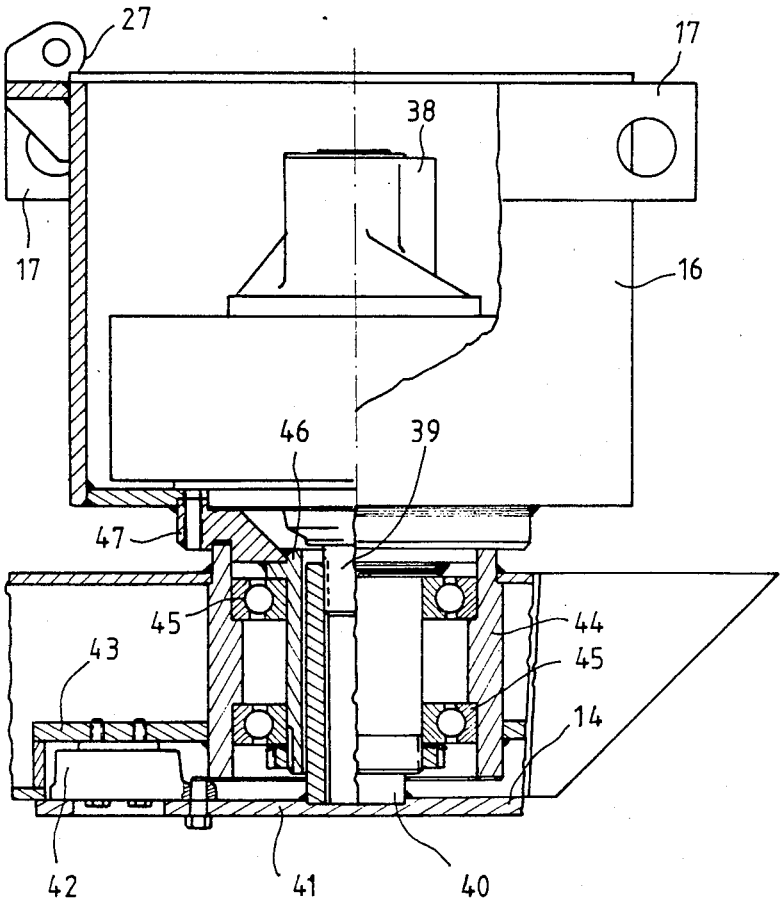
FIG. 3 is a partial sectional view, to an enlarged scale, of the means for rotatably mounting one of the cutters having an adjustable inclination.

As shown in Fig 3, each inclined cutter 14 is driven in rotation by a hydraulic motor 38 mounted in the corresponding housing 16. The output shaft 39 of the motor 38 has one splined end portion engaged in a corresponding splined sleeve 40 at the free end of which sleeve is welded a disc 41. Evenly spaced apart on the periphery of the disc 41 are resiliently yieldable coupling means 42 which connect the disc 41 to an annular element 43 which is welded to the hub 44 of the cutter. The hub 44 is rotatively mounted by means of rolling bearings 45 on a tube 46 rendered rigid with the housing 16 by a ring 47.

It can be seen that, owing to the resiliently yieldable coupling between the disc 41 and the annular element 43, it is possible to absorb small misalignments and small blows or impacts during the work of the cutters 14.

Figure 5:
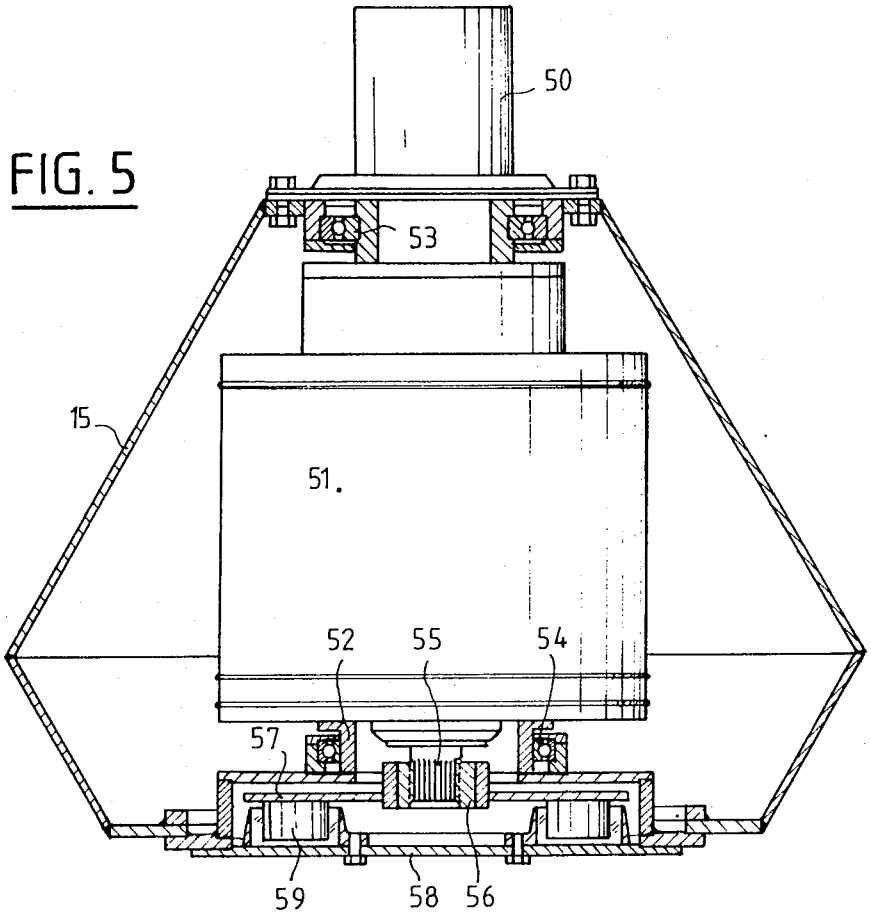
FIG. 5 is a sectional view of the means for rotatably mounting the front cutter of the machine.

FIG. 5 shows the mounting of the front cutter 15. This cutter is rotatively mounted on a tubular support 50 with which is rigidly connected the head 15*c* shown in FIG. 1 and to the end of which is fixed the housing of a hydraulic motor 51 for driving this cutter. The cutter 15 is supported, on one hand, by the tubular support 50 and, on the other hand, by an extension 52 coaxial with the housing of the motor 51, by means of rolling bearings 53,54. The transmission of the movement in rotation from the output shaft 55 of the motor 51 is ensured through a splined sleeve 56 in which is engaged the splined end portion of the output shaft 55 and on the outer surface of which is welded a plate 57 connected to an outer plate 58 forming the end of the cutter 15 through resiliently yieldable coupling means 59 which are evenly spaced apart on the periphery of the plates 57 and 58. It can be seen that the front cutter 15 is also connected to its driving shaft through resiliently yieldable coupling means which permit, here again, compensating for slight defects in alignment and absorbing small impacts or blows when the cutter rotates during the operation of the machine.

Figure 6:
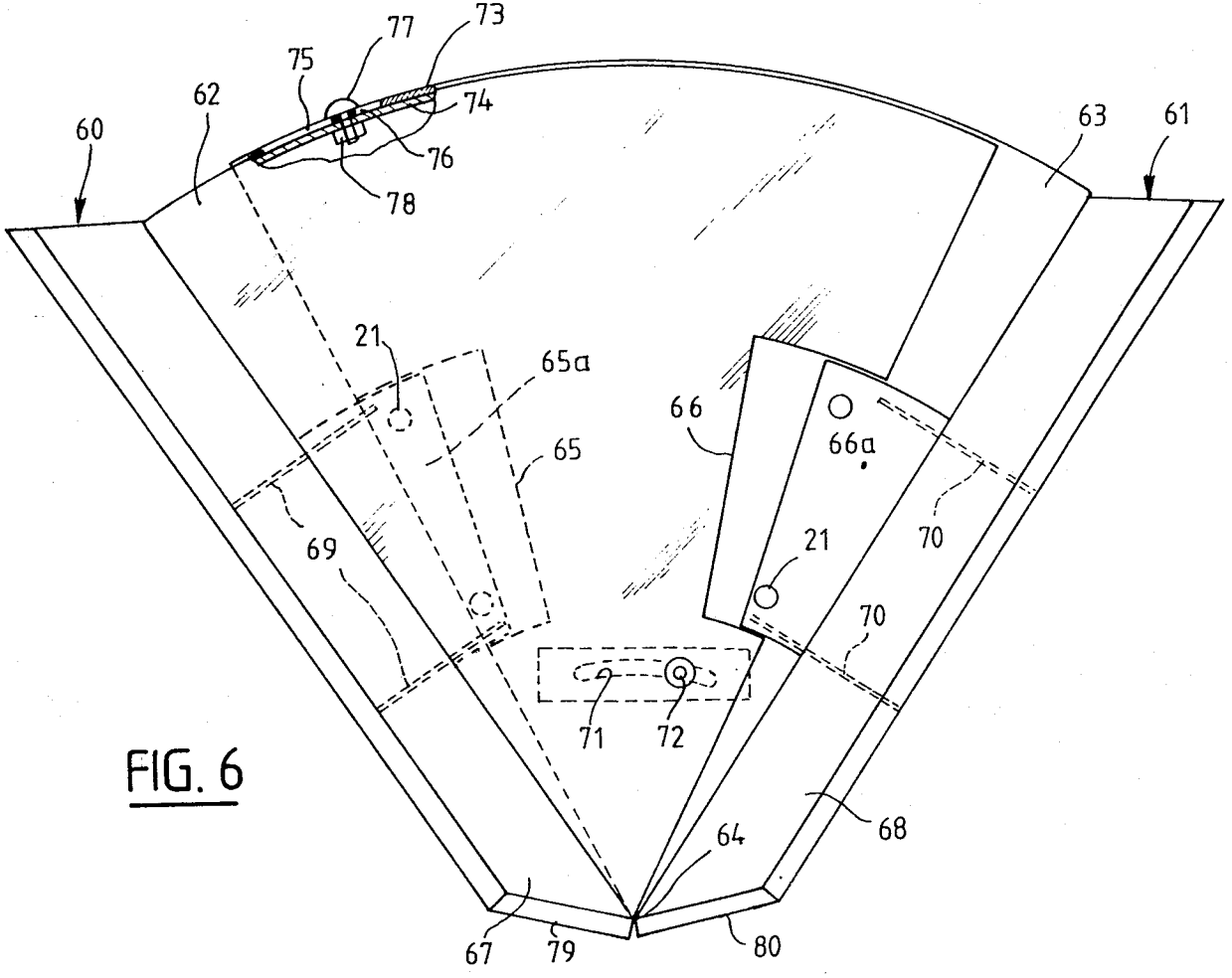
FIG. 6 is an end elevational view of the structure of the smoothing shoe of the machine according to the invention.

The smoothing or shaping shoe 20 will now be described in detail with reference to FIG. 6. This shoe consists of two elements 60, 61 which have planar portions 62, 63 which overlap in the form of circular sectors. They are pivotally mounted in such manner as to turn about an axis 64 intersecting the apex of these sectors. Each of the elements 60, 61 is supported by two tubular bars 21 the opposed ends of which are fixed to the corresponding rollers 18*a*, 18*b* for guiding and angularly shifting the inclined cutters 14. Formed in each of the portions 62 and 63, in the shape of circular sectors, is a corresponding recess 65, 66, the sheet metal scrap resulting from the cutting of each of these recesses constituting an element for thickening and reinforcing the corresponding uncut region of the other portion whereby it is possible to use for fixing the two elements 60 and 61 of the shoe tubular bars 21 of the same length. These cut-away portions 65*a*, 66*a* are, for example, welded to the solid regions of the portions 62, 63. At their ends opposed to the shoe, the tubular bars 21 are welded to the ends of the shafts of rotation of the guide rollers 18*a*, 18*b* fixed on the bars 17 rigid with the housing 16. The outer edges of the portions 62 and 63 in the shape of circular sectors are extended by lateral walls 67, 68 which constitute the active elements of the shaping shoe. These lateral edges are rendered rigid relative to the portions 62, 63 in the form of circular sectors by reinforcing gussets 69, 70. The shoe further comprises means for effecting a pivotal connection and a relative immobilization of the two elements constituted by a slot 71 in the shape of an arc of a circle formed in one of the elements in the shape of a circular sector and in which is engaged a rod 72 provided with a roller and a lock nut. These pivotal connection and immobilization means are completed by similar means provided in the peripheral flanges 73, 74 of the portions 62, 63 in the shape of a circular sector and constituted by a slot in the shape of an arc of a circle 75 in which is engaged a roller 76 through which extends a screw 77 carrying a clamping nut 78.

The lower ends of the lateral edges 67, 68 terminate in inclined flanges 79, 80 which are slightly upwardly and forwardly inclined in the direction of the front of the shoe in the direction of travel of the machine.

Further, these flanges 79, 80 make an angle therebetween in most of the relative positions of the two elements 60, 61 of the shoe so that the trench obtained has a corresponding hollow. However, if the shoe is in its completely deployed position, the two flanges 79, 80 are aligned so as to permit the obtainment in this position of a trench having a perfectly flat bottom.

If it is desired to dig a trench whose walls have a particular slope compatible with the capacity of variation of the inclination of the cutters 14 of the machine, the jack 31 is actuated and it actuates, through its rod 30 and the cross-member 29, the links 28. These links exert a force on the bars 17 of the housings 16 supporting the cutters 14 and shift the rollers 18*a*, 18*b* in the slots 19*a*, 19*b*. The difference in the inclination of these slots produces, at the same time as a slight displacement in height of the cutters 14, an angular displacement of the latter until the desired inclination is reached.

As the tubular bars 21 supporting the shoe 20 are fixed to the rollers 18*a*, 18*b* which move in the rear side wall 22 of the support 13, the variation of the inclination of the bars 17 carrying these rollers will produce a corresponding variation of inclination of the elements 60 and 61 of the shoe by rotation about the axis 64 and cause them to move apart or move toward each other in a corresponding manner, of course after an untightening of the immobilization means 71, 72 and 75 to 78. When the desired adjustment of the inclination of the cutters 14 and of the corresponding opening of the shoe 20 have been reached, a trench can be dug or cleaned out. The housings 16 of the cutters 14 are immobilized by the jack 31 itself or by suitable locking means (not shown). The two elements 60 and 61 of the shoe are immobilized relative to each other by the locking means 71, 72 and 75 to 78.

When the machine operates, it can be seen in FIG. 1 that the front cutter 15, whose depth of penetration may be adjusted by means of the deformable parallelogram structure actuated by the jack 15*d*, effects a rough digging of the trench which also serves as a passage for the main lateral cutters 14.

The depth of penetration of the machine is thus considerably increased so that this machine can produce in a single pass trenches that machines of the prior art had difficulty to produce in several passes.

The mounting of the cutters by resiliently yieldable coupling means results in an improved flexibility of operation and prolongs the life of the tooling.

When the machine according to the invention is employed for the cleaning out of trenches, only the main lateral cutters 14 are required so that the front cutter 15 may be dismantled for this utilization, this dismantling being achieved merely by uncoupling the links of the deformable parallelogram structure from the forks 80, 81 provided on the front side wall 22 of the support 13 together with the jack 15*d*. The supply of power to the hydraulic motor 51 of the cutter 15 must of course be stopped.

Thus it can be seen that the machine according to the invention has an increased flexibility of utilization relative to conventional machines.

What is claimed is:

1. A machine for digging and cleaning out trenches comprising a frame, a support carried by the frame, two cutters having a frustoconical shape and axes of rotation which are inclined to the horizontal, mounting means mounting said cutters on said support and comprising, for each cutter, a housing carrying guide rollers, slots defined by said support and having different inclinations, said rollers being guidedly engaged in said slots, means for adjusting the inclination of said axes for the purpose of modifying the inclination of walls of the trench to be produced, said means for adjusting the inclination comprising a jack mounted in said support, and links connecting said jack to said housings.

2. A machine according to claim 1, wherein rectilinear bars fixed to said housings carry said guide rollers.

3. A machine according to claim 1, wherein said support comprises two side walls in each of which side walls are provided two pairs of said slots for said guide rollers, said pairs of slots being disposed on each side of an axis of symmetry of the support.

4. A machine according to claim 1, wherein a suspension shaft connects said support to said frame and said support is inclinable transversely of the direction of travel of the machine.

5. A machine according to claim 1, further comprising an additional cutter disposed in front of said two inclined cutters relative to a direction of travel of the machine and adapted to effect a rough cutting of the trench to be produced by the machine, a deformable parallelogram structure connecting said additional cutter to said support, and a jack for adjusting the depth of the additional cutter relative to said frame and connected between said support and an element of the deformable parallelogram structure.

6. A machine according to claim 1, further comprising a smoothing shoe mounted at the rear of the machine, said shoe being made in two elements which are adjustable as concerns the opening thereof for adapting the inclination of lateral walls of said shoe to the slope of the walls of the trench to be produced.

7. A machine according to claim 6, wherein bars fix each of said two elements of said shoe to said guide rollers whereby the inclination of the inclined cutters thus controls the inclination of said lateral walls of said elements of the shoe.

8. A machine according to claim 6, wherein each of said elements of the shoe has a planar portion in the shape of a circular sector, said planar portions being mounted in such manner as to turn relative to each other about an axis intersecting a common apex of said planar portions by pivotal mounting means and means for immobilizing said elements.

9. A machine according to claim 1, comprising driving motors respectively for said cutters and having output shafts and resiliently yieldable couplings connecting said output shafts respectively to said cutters.

* * * * *